United States Patent [19]

Kostelnick

[11] 4,240,049

[45] Dec. 16, 1980

[54] WAVEGUIDE JUNCTION CIRCULATOR HAVING SPURIOUS MODE ABSORBING MEANS

[75] Inventor: Joseph J. Kostelnick, Bethlehem, Pa.

[73] Assignee: Bell Telephone Laboratories, Incorporated, Murray Hill, N.J.

[21] Appl. No.: 78,554

[22] Filed: Sep. 24, 1979

[51] Int. Cl.[3] ..... H01P 1/39; H01P 1/162

[52] U.S. Cl. ..... 333/1.1; 333/251

[58] Field of Search ..... 333/1.1, 251

[56] References Cited

U.S. PATENT DOCUMENTS

| | | | |
|---|---|---|---|
| 2,644,930 | 7/1953 | Luhrs et al. . | |
| 2,951,220 | 8/1960 | Miller . | |
| 3,103,639 | 9/1963 | Reggia . | |
| 3,251,011 | 5/1966 | Unger | 333/251 |
| 3,350,664 | 10/1967 | Pistilli et al. . | |
| 3,548,348 | 12/1970 | Gerdine | 333/251 |
| 3,555,459 | 1/1971 | Anderson . | |
| 3,662,291 | 5/1972 | Cotter . | |
| 3,781,704 | 12/1973 | DeGruyl . | |
| 3,845,413 | 10/1974 | Chiron . | |
| 3,873,944 | 3/1975 | Vaguine et al. | 333/1.1 |

OTHER PUBLICATIONS

Owen et al., *The Compact Turnstile Circulator,* IEEE Trans. MTT, Dec. 1970, pp. 1096–1100.

Tan et al., *Suppression of Higher Order Modes in Waveguide-Junction Circulators, etc.,* IEEE Trans. MTT, May 1976, pp. 271, 272.

*Primary Examiner*—Paul L. Gensler

*Attorney, Agent, or Firm*—Lester H. Birnbaum

[57] ABSTRACT

A waveguide junction circulator which includes means for absorbing spurious modes. A thin, lossy element (15) is provided surrounding a portion of the gyromagnetic member (4) and orthogonal to the electric field of the incident wave. The incident wave is unaffected, but the spurious modes which are produced in the gyromagnetic member and exist as high Q resonances are selectively absorbed. The lossy element is typically a thin film resistor formed on a dielectric film.

8 Claims, 4 Drawing Figures

WAVEGUIDE JUNCTION CIRCULATOR HAVING SPURIOUS MODE ABSORBING MEANS

BACKGROUND OF THE INVENTION

This invention relates to waveguide junction circulators, and in particular to means for absorbing spurious modes produced therein.

Circulators are used in a variety of microwave transmission systems for interconnecting microwave components with little reflection. One particular type of circulator is the waveguide junction circulator which consists of at least three branches each coupled to a waveguide of the transmission apparatus. These branches converge at a junction wherein there is disposed a nonreciprocal gyromagnetic material, such as a ferrite. A magnetic field is applied to this element so that a wave incident thereon will produce various modes inside and outside the element which cause the energy to be coupled to one of the adjacent branches but not the other. Thus, the microwave signal can be transmitted in only one direction in the circular without undesired reflection in the other direction. If a resistive termination is coupled to one of the branches, the circulator is used as an isolator to prevent reflection of waves from one component to another.

Although the exact nature of the modes produced in a waveguide junction circulator are not well understood, it appears that the incident wave is split by the gyromagnetic element into a set of dielectric modes comprising a linearly polarized in-phase mode, a right circularly polarized mode, and a left circularly polarized mode. The latter two modes have an electric field orthogonal to that of the incident wave and travel the length of the gyromagnetic body, which body has its axis parallel to the electric field of the incident wave. It is the interaction of all three modes which produces the circulator action (for a more detailed discussion, see Owen and Barnes "The Compact Turnstile Circulator," *IEEE Transactions on Microwave Theory and Techniques,* Vol. MTT-18, No. 12, pages 1096–1100 (December 1970), which is incorporated by reference herein).

It is found, however, that certain higher order, spurious modes which do not contribute to circulator action will also be produced by the gyromagnetic material. These spurious modes produce resonance spikes which often lie in the desired passband frequency of the propagated wave thereby reducing the width of the useable passband and in general adversely affecting electrical characteristics. One approach in dealing with these spurious modes involves choosing the proper length-to-diameter ratio of the gyromagnetic element so that the resonant spikes are moved out of the passband. Because the fields of both the circulator modes and the spurious modes occupy the same space, it is difficult to achieve the necessary differential control to move the spurious responses out of band by this method. Some recent alternative suggestions have been directed toward suppression of such unwanted modes. These usually involve use of a metal ring disposed between stacked ferrite elements (see, for example, U.S. Pat. No. 3,662,291, issued to Cotter. It has also been proposed to suppress unwanted modes by placing a metal ring on top of an open faced gyromagnetic element (see, for example, Tan and Helszajn, "Suppression of Higher Order Modes in Waveguide-Junction Circulators Using Coupled Open Dielectric Resonators," *IEEE Transactions on Microwave Theory and Techniques,* May 1976, pages 271–273). Such approaches basically seek to detune the spurious modes and thereby move them outside the passband.

It is a primary object of the invention to provide an alternative means for removing spurious modes produced in waveguide junction circulators by absorbing those modes with little or no effect on the propagating wave.

SUMMARY OF THE INVENTION

This and other objects are achieved in accordance with the invention. The microwave circulator comprises at least three waveguide sections converging at a central junction, a body of nonreciprocal gyromagnetic material disposed at the junction to receive a microwave signal transmitted through the waveguide sections, and means for applying a magnetic field to the gyromagnetic body. Means for absorbing spurious modes created in the body by the transmitted signal is included. The means comprises a thin layer of lossy material disposed around a portion of the exterior surface of the body and perpendicular to the electric field of the transmitted signal.

BRIEF DESCRIPTION OF THE DRAWING

These and other features of the invention are delineated in detail in the following description. In the drawing.

It will be appreciated that for purposes of illustration these figures are not necessarily drawn to scale.

DETAILED DESCRIPTION

Figure 1:
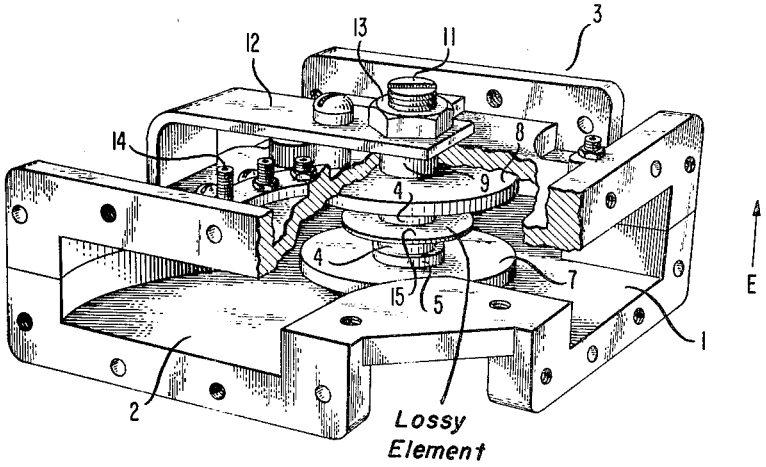
FIG. 1 is an isometric view, with a portion broken away, of a waveguide junction circulator in accordance with one embodiment of the invention.
Figure 2:
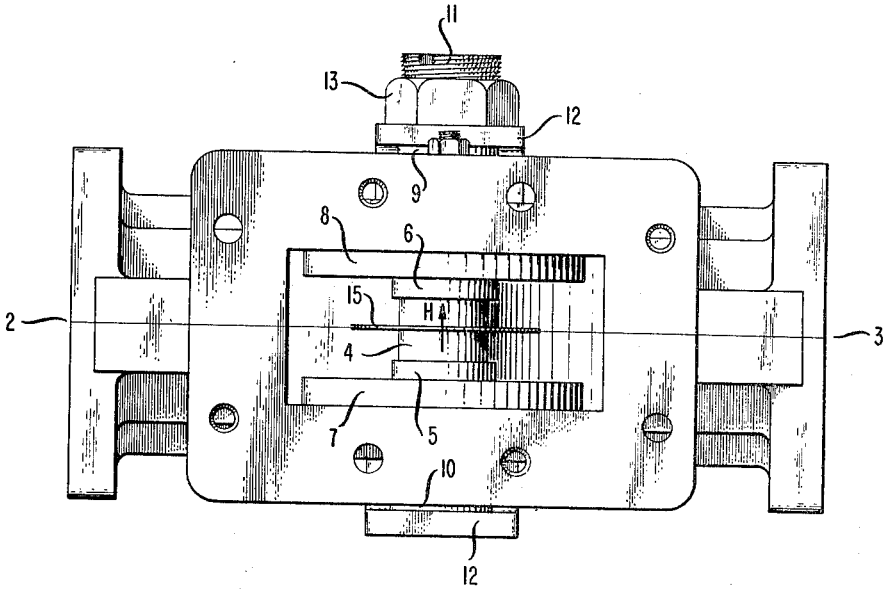
FIG. 2 is a side view through one waveguide section of the circulator of FIG. 1.

The waveguide junction circulator in accordance with one embodiment of the invention will now be described with reference to the views of FIGS. 1 and 2. It will be noted that the circular is a conventional Y-type circulator with 3 coplanar waveguide sections, 1, 2, and 3, converging at a junction and with each making an angle of 120 degrees with adjacent sections. Of course, it will be realized that the device may comprise more than three sections. At the junction of the waveguide sections, there is disposed a nonreciprocal gyromagnetic element, 4, which in this case is a ferrite. In this example, the element was in the shape of a right-circular cylinder with its axis parallel to the plane of the electric field of the incident wave symbolized by the arrow labeled E in FIG. 1. The element may also typically be triangular in shape (see, for example, U.S. Pat. No. 3,350,664, issued to Pistilli, et al). In this particular example, the ferrite comprised gadolinium and aluminum doped yttrium-iron garnet, with a height of 0.31", a diameter of 0.49", and a saturation magnetization of 1100 gauss.

In accordance with known practice, the ferrite element was mounted at both ends in circular discs, 5 and 6, of a low dielectric constant material such as cross-linked polystyrene which is sold by Rex Corporation under the trade name Rexolite. These discs permit the ferrite to be displaced from the upper and lower metal surfaces for improved performance. These dielectric discs were, in turn, centered on circular metal discs 7 and 8. These metal discs perform the function of impedance matching by an appropriate choice of dimensions. In this particular example, the discs, which were aluminum, had a diameter of 1.4" and a height of 0.14". These discs were adjacent to the top and bottom inside surfaces of the waveguide junction area as shown. Cylindrical magnets 9 and 10 were mounted in recesses in the top and bottom outside surfaces respectively, of the waveguide junction area. The magnets were held in place by the combination of screw 11 abutting the top surface of magnet 9, a C-shaped clamp, 12, through which the screw was threaded and which extended around the waveguide section to abut the bottom surface of magnet, 10, and nut 13. In this example, the magnets were made of alnico. The magnets create a magnetic field in the ferrite in a plane parallel to the electric field of the incident wave as illustrated by the arrow labeled H in FIG. 2. Screws 14 which extend into the waveguide sections are also provided for tuning the propagated signal.

Figure 4:
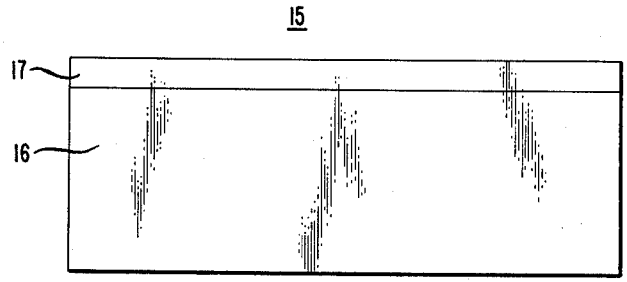
FIG. 4 is an enlarged side view of one element of the apparatus of FIGS. 1 and 2.

In accordance with a key feature of the invention, a thin, lossy element, 15, was provided on a portion of the cylindrical surface of the ferrite element 4. The purpose of this element is to absorb the spurious modes created in the ferrite while essentially having no effect on the incident wave or the modes required for circulator action, as described in more detail below. In this particular example, the element was formed into a washer shape with an inner diameter equal to that of the ferrite and an outer diameter of approximately 0.96". The element was cut from a resistance card which is sold by Solitron Microwave, Inc., and generally designated as "Metallized Mica Resistance Cards". As shown in FIG. 4, the resistance card comprises a dielectric film, 16, in this case mica, on which is deposited a thin film resistor layer, 17, comprising nichrome. The dielectric film was approximately 5 mils thick and the resistor layer was approximately 100 Angstroms thick. The resistivity of the resistor was approximately 150 ohms/□.

The inner surface of the element was bonded to the ferrite element by means of 3 dots of an epoxy so that the resistor layer, 17, was orthogonal to the electric field of the incident wave and at a position of approximately ½ the height of the ferrite cylinder. The placement of the layer orthogonal to the electric field is important so that the incident wave will be essentially unaffected by the presence of this lossy element. For the same reason, it is important that the resistor be very thin. A recommended upper limit thickness for the thin film resistor is approximately 15,000 Angstroms to avoid loss of the incident energy. It does not appear that the height placement of the element is critical as long as it is placed a reasonable distance from the top or bottom of the ferrite cylinder.

In operation, the incident waveguide mode is coupled to the ferrite and travels along the axis of the ferrite cylinder as a set of dielectric modes with electric fields within the ferrite and components of electric fields external to the ferrite in a plane orthogonal to that of the electric field of the incident wave. Spurious modes with similar fields are also formed. However, these spurious modes apparently exist as high Q resonances which are trapped within the ferrite and make several passes up and down the ferrite before being coupled out. It is therefore theorized that the lossy element in accordance with the invention will absorb these spurious modes while having little effect on the well-coupled modes which make only one pass through the ferrite. Also, the lossy element will have an insignificant effect on the incident wave itself due to the fact that the element is thin and lies in a plane orthogonal to the electric field of the incident wave. The result is that the spurious modes will be selectively absorbed while the fundamental mode will be essentially unimpeded in its propagation through the circulator.

Figure 3:
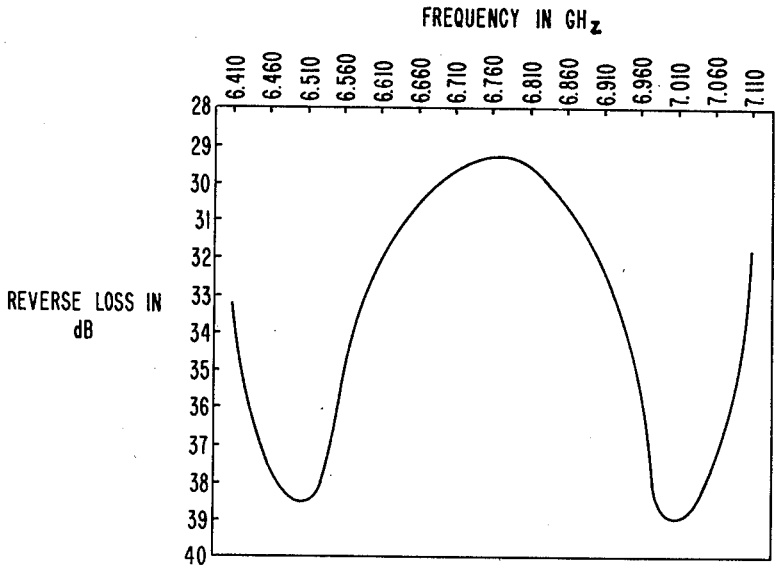
FIG. 3 is a graph of the frequency response of a circulator made in accordance with one embodiment of the invention.

The circulator fabricated in accordance with the above example operated at 6.4–7.1 GHz with an insertion loss of less than 0.3 dB and a reverse loss and return loss of greater than 28 dB. The frequency response curve is shown in FIG. 3 in the form of the reverse loss as a function of frequency. It will be noted that spurious modes, which would be evidenced by resonant spikes in the desired passband, have been eliminated by the lossy element, thus permitting broadband operation.

It will be realized that the lossy element need not be the particular material described, but can include any type of resistive element capable of absorbing power from the electric fields of the spurious dielectric modes in the gyromagnetic material. Preferably the resistivity of such an element will be in the range 25–750 ohms/□ for optimum absorption of the spurious modes. It also appears that the diameter of the element should be at least .75" for adequate absorption. The shape of the lossy element need not be circular and may, for example, be triangular when used with a triangular ferrite element. It will also be realized that the film which supports the resistive element can be any suitable dielectric other than mica, such as glass or mylar. Further, although the resistive element has been described as a thin film resistor, it may be possible to utilize resistors formed by standard thick film technology. It should also be realized that although the waveguide sections shown in the example are rectangular, the invention should also be applicable to circular waveguides.

Various additional modifications will become apparent to those skilled in the art. All such variations which basically rely on the teachings through which the invention has advanced the art are properly considered within the spirit and scope of this invention.

I claim:

1. A microwave circulator comprising at least three waveguide sections (1, 2 and 3) converging at a central junction, a body of nonreciprocal gyromagnetic material (4) disposed at said junction to receive a microwave signal transmitted through said waveguide sections, and means (9 and 10) for applying a magnetic field of said body CHARACTERIZED IN THAT there is further included means for absorbing spurious modes created in said body comprising an element (15) including a thin layer (17) of lossy material disposed around a portion of the exterior surface of said body and perpendicular to the electric field of the transmitted signal.

2. The circulator according to claim 1 wherein the thickness of the layer is less than 15,000 Angstroms.

3. The circulator according to claim 1 wherein the lossy material has a resistivity within the range 25–750 ohms/□.

4. The circulator according to claim 1 wherein the nonreciprocal gyromagnetic body is in the shape of a right circular cylinder with its axis parallel to the electric field of the transmitted signal.

5. The circulator according to claim 4 wherein the element is in the shape of a washer with its inner surface bonded to the cylindrical surface of the gyromagnetic body.

6. The circulator according to claim 1 wherein the element comprises a thin film resistor formed on a dielectric film.

7. The circulator according to claim 6 wherein the thin film resistor comprises nichrome.

8. A microwave circulator comprising at least three waveguide sections (1, 2 and 3) converging at a central junction, a cylindrical body of ferrite material (4) disposed at said junction to receive a microwave signal transmitted through said waveguide sections, said material being mounted in dielectric discs (5 and 6) which are in turn adjacent metal discs (7 and 8) at the top and bottom surfaces of the junction, and means (9 and 10) for applying a magnetic field to said body CHARACTERIZED IN THAT there is further included means for absorbing spurious modes created in said ferrite body comprising a washer-shaped element with its inner surface bonded to a portion of said body and oriented perpendicular to the electric field of the transmitted signal, said element including a thin film resistor having a resistivity in the range 25–750 ohms/square.

* * * * *